United States Patent [19]

Cox

[11] 4,203,004

[45] May 13, 1980

[54] STRAIN RELIEF

[75] Inventor: Albert R. Cox, Centerville, Ind.

[73] Assignee: Belden Corporation, Geneva, Ill.

[21] Appl. No.: 898,170

[22] Filed: Apr. 20, 1978

[51] Int. Cl.[2] ..... H01R 13/56

[52] U.S. Cl. ..... 174/135; 339/101

[58] Field of Search ..... 174/65 G, 135, 153 G; 339/101, 102 R, 102 L, 103 R, 103 B, 103 M

[56] References Cited

U.S. PATENT DOCUMENTS

| | | | |
|---|---|---|---|
| 2,272,432 | 2/1942 | Rogie | 339/101 X |
| 2,386,000 | 10/1945 | McQuiston | 339/101 |
| 2,727,088 | 12/1955 | LaWall | 339/101 X |
| 2,954,541 | 9/1960 | King | 339/101 X |
| 3,051,774 | 8/1962 | Schelke | 339/101 X |
| 3,395,244 | 7/1968 | Koehler | 339/101 X |
| 3,497,608 | 2/1970 | Elliott et al. | 339/101 X |
| 3,800,068 | 3/1974 | Torgerson | 339/102 R X |

FOREIGN PATENT DOCUMENTS

| | | | |
|---|---|---|---|
| 1105275 | 6/1955 | France | 339/101 |
| 587866 | 5/1947 | United Kingdom | 339/101 |

*Primary Examiner*—Laramie E. Askin

*Attorney, Agent, or Firm*—Fitch, Even & Tabin

[57] ABSTRACT

A strain relief for an electrical conductor cord is disclosed for distributing a bending stress acting on the cord. The strain relief includes a head portion and a flexible tail portion molded about a conductor having a major transverse axis of greater dimension than its minor transverse axis. A bending force acting on the cord in a direction to effect bending about a bend axis nonparallel to the major transverse axis of the cord induces both bending and torsional movement of the strain relief so as to distribute the flexure strain over the length of cord within the strain relief and thereby increase the flexure life of the cord.

17 Claims, 7 Drawing Figures

STRAIN RELIEF

The present invention relates generally to strain reliefs for electrical cords, and more particularly to an improved strain relief adapted to be molded about an electrical cord having a greater major transverse axis than its minor transverse axis, the strain relief having a configuration such that a bending force acting on the cord in a direction to bend the cord about a bend axis nonparallel to its major transverse axis induces both bending and torsional movement in the strain relief to distribute flexure strain along the cord and increase its flexure life.

It is known to employ strain reliefs in attaching electrical cords to electrical appliances and the like so as to relieve flexing strain and thereby increase the flex life of the electrical cord, particularly in applications where the cords are subjected to considerable flexing relative to the associated electrical apparatus. The known strain reliefs generally include means for attaching them to an electrical apparatus and have a tail portion firmly engaging a portion of the cord in a manner to cause the cord to bend in an arcuate configuration and eliminate sharp bends in the cord at the appliance which, after repeated flexing, may cause premature failure of the cord. An example of such a prior art strain relief is disclosed in U.S. Pat. No. 3,800,868, dated Mar. 26, 1974, and assigned to the assignee of the present invention.

Other examples of strain reliefs for use with electrical cords are disclosed in U.S. Pat. Nos. 2,386,000, 2,727,088, 3,395,244 and 3,497,608.

While the known strain reliefs as exemplified in the aforenoted United States patents have proven generally satisfactory in prolonging the flexure life of electrical cords having circular configurations, they do not significantly extend the flexure life of an electrical cord having two or more parallel juxtaposed conductors retained within an integral insulation cover and defining a noncircular transverse configuration. With the latter type of electrical cord, the major transverse axis of the cord is greater than the minor transverse axis and substantially greater resistance to bending is encountered when the bending force applied to the cord acts in a direction nonparallel to a plane containing the minor axis of the cord and normal to the major transverse axis. Stated alternatively, when a bending force acting on the cord tends to bend the cord about a bend axis nonparallel to the major transverse axis of the cord, substantially greater resistance to bending is encountered with the result that the cord undergoes significantly greater bending stress. Such bending stress acting on the cord at a position adjacent to an appliance to which the cord may be connected tends to subject the cord to substantially greater flexure fatigue and may lead to premature failure of the cord.

One of the primary objects of the present invention is to provide a novel strain relief for use with an electrical cord having a greater major transverse axis than its minor transverse axis, the strain relief being cooperative with the cord such that a bending force applied to the cord in a direction to cause bending thereof about a bend axis non-parallel to the major transverse axis of the cord is distributed over the cord in a manner to prolong the flex life of the cord.

A more particular object of the present invention is to provide a novel strain relief for use with an electrical cord having a greater major transverse axis than its minor transverse axis, the strain relief including a head portion adapted for attachment to an appliance and further including a tail portion adapted to receive the cord coaxially therethrough and having a configuration which causes the tail portion to undergo both bending and torsion when the cord is subjected to a force tending to bend the cord about a bend axis nonparallel to the major transverse axis of the cord so as to distribute the flexure stress over the length of the cord disposed within the strain relief. Such elimination of a focal point of bending in the cord significantly increases the flex life of the conductor.

Another object of the present invention is to provide a novel strain relief for use with an electrical cord having parallel generally coplanar conductors, the strain relief being molded coaxially about the cord and having a head portion adapted for attachment to an appliance, and a flexible tail portion defining section moduli about the major and minor transverse axes of the cord which progressively decrease in magnitude in the direction away from the head portion so as to cause both arcuate bending and torsional movement of the tail portion when the cord is subjected to bending about a bend axis nonparallel to the major transverse axis of the cord.

A feature of the strain relief in accordance with the present invention lies in the provision of a distal end portion integral with the tail portion and opposite the head portion, which distal end portion is configured to provide greater flexibility at the point of entry of the cord into the strain relief so as to better distribute the flexure stress along the cord disposed within the strain relief.

Further objects and advantages of the present invention, together with the organization and manner of operation thereof, will become apparent from the following detailed description of the invention when taken in conjunction with the accompanying drawing wherein like reference numerals designate like elements throughout the several views, and wherein.

Figure 1:
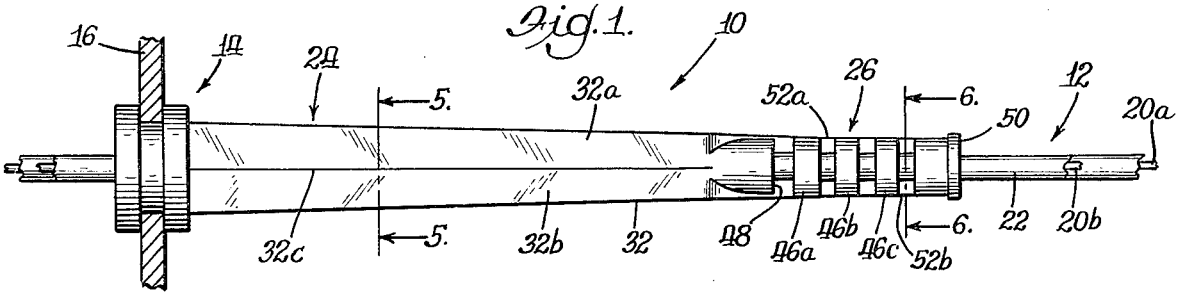
FIG. 1 is a side elevational view of a strain relief in accordance with the present invention molded about an electrical cord, the head portion of the strain relief being shown mounted within a wall of an appliance housing or casing.

Referring now to the drawing, a strain relief constructed in accordance with a preferred embodiment of the present invention is indicated generally at 10. The strain relief 10 is illustrated as being formed about an electrical conductor cord 12 and includes a head portion 14 which facilitates connection of the strain relief to a wall or housing, a portion of which is indicated at 16. The wall 16 may represent a portion of an appliance, tool, cabinet or other device to which the cord 12 is connected for supplying electrical power to the appliance, tool or other device, or for distributing electrical power from the device. As will become more apparent hereinbelow, the strain relief 10 serves to distribute the bending or flexing stress on the cord 12 over the length thereof disposed within the strain relief 10 in a manner to substantially improve the flex life of the conductor.

The conductor cord 12 has two parallel electrical conductor wires 20*a* and 20*b* which are enclosed in an insulating sheath 22 to maintain the electrical wires in integrally assembled parallel relation. The conductor cord 12 thus has a major transverse axis and a minor transverse axis, the ratio of the major transverse dimension to the minor transverse dimension in the illustrated embodiment being approximately 2:1.

The strain relief 10 is made of a resilient flexible material, such as polyvinyl chloride, and may be injection molded about the electrical conductor cord 12 so as to be formed coaxially thereon. The strain relief includes a flexible tail portion, indicated generally at 24, integral with the head portion 14 and extending axially outwardly therefrom. The tail portion 24 terminates at its end opposite the head portion 14 in an outer end 26 which, as will be described more fully hereinbelow, has greater resiliency during bending than the tail portion 24.

As aforementioned, the strain relief 10 is adapted to be attached to the wall or housing 16. It will be appreciated that bending a conductor which extends from an appliance or other device will generally cause the conductor to bend sharply at the point of connection to the appliance. As a result, continued bending or flexing of the conductor cord normally effects a flexure or stress failure in the area of its connection to the appliance. The strain relief 10 serves to prevent a sharp bend in the cord in the area of its connection to an appliance or the like and distributes the flexure stress on the conductor cord along a greater portion of its length so as to substantially improve the flexure life of the conductor.

With the electrical conductor cord 12 having a major transverse dimension greater than its minor transverse dimension, bending of the cord about a bend axis parallel to its major transverse axis creates a generally uniform bend of sufficient arc radius so that severe localized stresses are not established in the cord. However, when a cord of this type is subjected to a bending force acting on the conductor in a manner to bend the cord about a bend axis nonparallel to the major transverse axis of the cord, substantially greater resistance to bending is encountered with the result that twisting and a more severe bend angle in the cord is normally effected. As a result of this greater resistance to bending and the rather sharp bend angle which the electrical cord assumes when subjected to a bending force acting other than parallel to the minor transverse axis of the cord, the cord undergoes substantially greater flexure stress with the result that flexure fatigue may cause failure of the electrical conductor wires 20*a* and 20*b*. The strain relief 10 in accordance with the present invention eliminates a focal point of twisting and sharp bending of the conductor cord and thereby increases the flex life of the cord by distributing the flexure stress along the length of the conductor cord when the cord is subjected to a bending force, and particularly when the bending force bends the cord about a bend axis nonparallel to the major transverse axis of the conductor.

Figure 7:
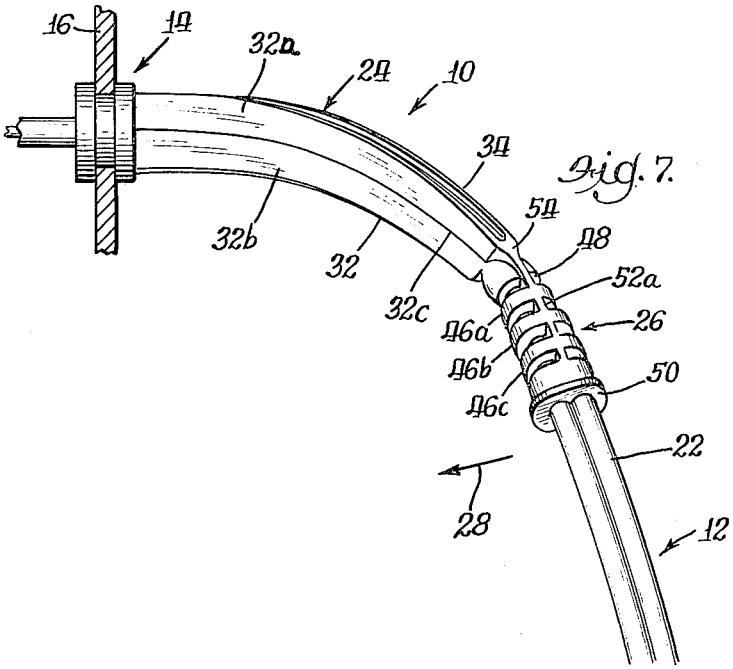
FIG. 7 is a perspective view illustrating the strain relief and associated cord in a flexed or bent position.

To accomplish the intended purpose of the strain relief 10, the tail portion 24 has a transverse cross-sectional configuration throughout its longitudinal length configured so that a bend force, such as acting in the direction indicated by arrow 28 in FIG. 7, applied to the cord at an angle tending to bend the cord about a bend axis nonparallel to the major transverse axis of the cord will induce both bending and rotational torsion in the tail portion in a manner to distribute the bending strain on the cord along substantially the full length of the cord disposed within the strain relief. The tail portion 24 has a substantially H-shaped transverse configuration throughout its length between the head portion 14 and the distal end 26. The H-shaped is defined by parallel lateral side walls 32 and 34 integrally interconnected by a web portion 36. The strain relief 10 is molded about the conductor 12 such that the cord 12 is embedded within the web portion 36 centrally thereof. The outer external surfaces of the side walls 32 and 34 are preferably inclined outwardly as at 32*a*, 32*b* and 34*a*, 34*b* and establish ridges 32*c* and 34*c* which lie in a plane coplanar with the major transverse axis of the conductor cord 12 is represented by the line 40 in FIG. 5.

As best seen in FIG. 1, the transverse cross sectional area of the flexible tail portion 24 progressively and uniformly decreases along the length of the tail portion from the head portion 14 to the terminal end 26. The progressively decreasing cross sectional area of the tail portion 24 is accomplished by progressively reducing the vertical dimension of the side walls 32 and 34, as considered in FIGS. 1 and 5, so as to taper the side profile of the side walls progressively from the head portion 14 to the distal end 26. As a result of such progressively decreasing cross-sectional configuration, the flexure of the strain relief adjacent the distal end 26 is greater than the flexure adjacent the head portion 14 and uniformly changes from the end of greatest flexure adjacent the distal end to the end of greatest relative stiffness adjacent the head portion.

Figure 5:
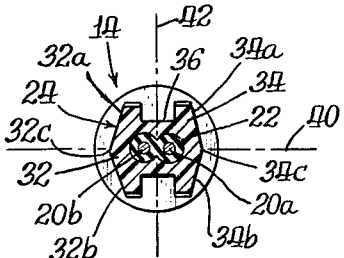
FIG. 5 is a transverse sectional view taken substantially along the line 5—5 of FIG. 1, looking in the direction of the arrows.
Figure 6:
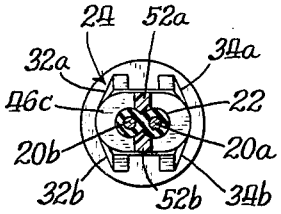
FIG. 6 is a transverse sectional view taken substantially along the line 6—6 of FIG. 1.
Figure 4:
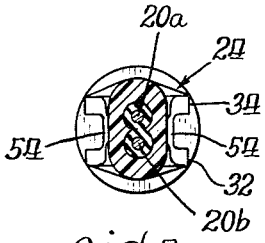
FIG. 4 is a transverse sectional view taken substantially along the line 4—4 of FIG. 2, looking in the direction of the arrows.

It is seen from FIGS. 4–6 that the area of a transverse cross section of the tail portion 24, taken at substantially any point along its longitudinal length, is symmetrical about both the major transverse axis of the conductor cord 12, as represented by the line 40, and about the minor transverse axis of the conductor cord, as represented by the line 42 in FIG. 5.

The line 40 represents an axis of zero flexural stress within the strain relief and associated conductor cord 12 when the cord is subjected to a force tending to bend the cord about a bend axis parallel to the major transverse axis of the cord; i.e., a bend axis parallel to the line 40. Similarly, the line 42 represents an axis of zero flexural stress within the strain relief and associated conductor cord when the cord is subjected to a bending force tending to bend the cord about a bend axis parallel to the minor transverse axis of the cord, i.e. a bend axis parallel to line 42. In accordance with the present invention, and as a result of the progressively and uniformly decreasing transverse cross-sectional area along the length of the flexible tail portion 24 of the strain relief, the transverse section modulus about the zero or minor transverse axis 42 at any point along the flexible tail portion of the strain relief is greater than the transverse section modulus about the zero or major transverse axis 40 at the same point along the strain relief. As a result of this difference in section moduli at any given point along the length of the flexible tail portion 24, a force applied to the electrical cord which acts on the cord adjacent the strain relief 10 in a direction which tends to bend the cord about a bend axis other than parallel to the major transverse axis of the cord, i.e., a bend axis other than parallel to the plane 40, will induce both bending of the strain relief in the direction of the applied force and also torsional rotation of the strain relief about its longitudinal axis, as best illustrated in FIG. 7. Such combined bending and rotation of the strain relief effects a corresponding rotational movement of the cord disposed within the strain relief about its longitudinal axis so as to establish a bend axis which more closely parallels the major transverse axis of the cord. In this manner a focal point of twisting in the cord which, upon repeated flexing of the cord, could result in flexure or fatigue failure of the conductors 20*a* and 20*b* is eliminated.

Figure 2:
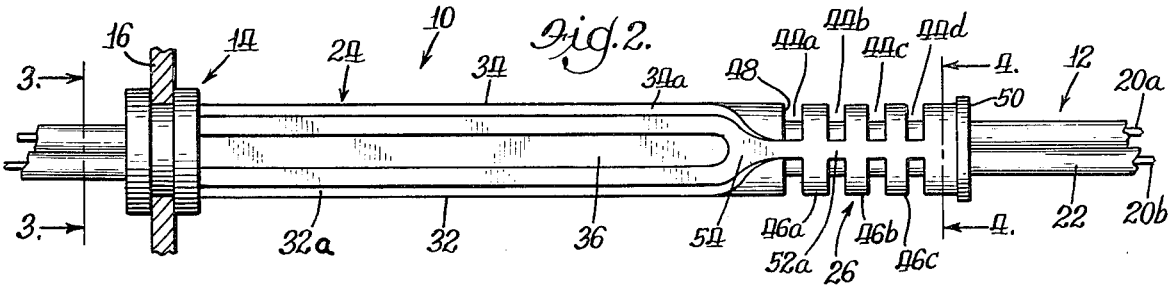
FIG. 2 is a top plan view of the strain relief of FIG. 1.
Figure 3:
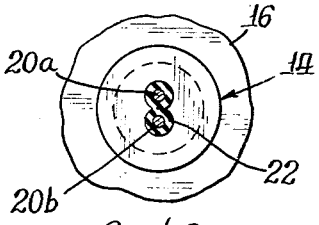
FIG. 3 is a fragmentary transverse sectional end view taken substantially along the line 3—3 of FIG. 2, looking in the direction of the arrows.

The distal end 26 of the strain relief has a plurality of openings 44*a, b, c* and *d* which extend radially through the distal end and communicate with the cord 12. The openings 44*a–d* define a plurality of transverse ribs 46*a, b* and *c* which are interposed between an end surface 48 of the tail portion 24 and an outermost end 50 of the strain relief. The ribs 46*a, b* and *c* are of substantially equal oval configuration, considered transversely of the strain relief, and are formed integral with longitudinal connecting ribs 52*a* and 52*b* which blend with the respective upper and lower edge surfaces of the side walls 32 and 34 of the tail portion 24 such as indicated at 54 in FIG. 2. The ribs 46*a–c* are spaced equally along the longitudinal connecting ribs 52*a, b* and afford greater flexibility for the distal end 26 than the tail portion 24.

Thus, it is seen that employing the strain relief 10 in conjunction with an electrical cord, and particularly a noncircular cord having a greater major transverse axis than its minor transverse axis, substantially improves the distribution of flexure strain on the cord when subjected to a bending force tending to bend the cord about a bend axis nonparallel to the major transverse axis of the cord. The distal end 26 of the strain relief provides substantial flexibility at the entry end of the strain relief, while the tail portion effects progressively greater resistance to bending in the direction of the head end portion 14. By constructing the strain relief so that a force applied to the electrical cord in a direction tending to bend the cord about a bend axis nonparallel to the major transverse axis of the cord induces both bending and torsion of the strain relief, the portion of the electrical cord disposed within the strain relief is prevented from undergoing a sharp bend angle, with the result that the cord undergoes a gradual bend radius about a bend axis more closely approaching parallelism with the major transverse axis of the cord.

A significant advantage of the strain relief 10 in accordance with the present invention is that if the cord 12 should undergo a flex failure, the flex failure will occur within the confines of the strain relief so that there is little possibility of an explosive type failure that could endanger the user or property in close proximity to the cord or device with which the cord is used. Thus, the strain relief 10 provides substantially increased safety.

While a preferred embodiment of the strain relief in accordance with the present invention has been illustrated and described, it will be understood that changes and modifications may be made therein without departing from the invention in its broader aspects.

Various features of the invention are defined in the following claims.

What is claimed is:

1. A strain relief for use with a cord having a major transverse axis and a minor transverse axis, said major transverse axis having greater magnitude than said minor axis, said strain relief having an axial bore adapted to receive said cord therethrough in close fitting relation therewith, said strain relief defining a head portion adapted for mounting said strain relief on a separate support plate or the like, a flexible tail portion contiguous to said head portion, and a distal end opposite said head portion, said flexible tail portion having a generally H-shaped transverse cross sectional configuration throughout substantially its full longitudinal length so as to define a transverse section modulus about said minor transverse axis which is greater in magnitude than the corresponding transverse section modulus about said major transverse axis, said transverse configuration of said flexible tail portion causing said tail portion to undergo both bending and torsion about its longitudinal axis when a cord disposed within said axial bore is subjected to a bending force tending to bend said cord about a bend axis nonparallel to its said major transverse axis.

2. A strain relief as defined in claim 1 wherein said transverse section moduli differ throughout the full length of said flexible tail portion.

3. A strain relief as defined in claim 1 wherein said head portion, flexible tail portion and distal end are molded as a unitary strain relief body.

4. A strain relief as defined in claim 3 wherein said strain relief is molded from a flexible material.

5. A strain relief as defined in claim 1 wherein said distal end has greater lateral flexibility than said tail portion.

6. A strain relief as defined in claim 1 wherein said generally H-shaped configuration is defined by laterally spaced walls integrally interconnected by a web portion.

7. A strain relief as defined in claim 6 wherein said axial bore extends centrally through said web portion.

8. A strain relief as defined in claim 6 wherein said laterally spaced walls have outwardly facing inclined surfaces during longitudinal ridges which lie in a plane coplanar with a plane containing the major transverse axis of said flexible tail portion and normal to said minor transverse axis.

9. A strain relief as defined in claim 1 wherein said flexible tail portion tapers progressively inwardly from said head portion to said distal end when viewed in side elevational profile.

10. A strain relief as defined in claim 9 wherein said taper is progressively uniform throughout the length of said flexible tail portion.

11. In combination, a flexible conductor cord and a strain relief, said cord having a major transverse axis and a minor transverse axis, said major transverse axis being of greater magnitude than said minor transverse axis, said strain relief including a head portion and an elongatd flexible tail portion extending from said head portion and terminating in a distal end, said head, tail and distal end portions defining an axial bore receiving said cord therethrough, said tail portion having a substantially H-shaped transverse cross sectional configuration throughout its longitudinal length configured so that a bend force applied to said cord at an angle tending to establish a bend axis nonparallel to the major transverse axis of the cord will induce both bending and torsion of said tail portion relative to its longitudinal axis so as to distribute the bending of said cord along substantially the full length of said strain relief.

12. The combination as defined in claim 11, wherein said tail portion defines two planes of symmetry disposed substantially perpendicular to each other and each being coplanar with a different one of said major and minor transverse axes of said cord disposed within said tail portion so as to intersect at the longitudinal axis of said tail portion.

13. The combination of claim 12 wherein said flexible tail portion has a transverse section modulus about said minor transverse axis which is greatr in magnitude than its section modulus about said major transverse axis.

14. The combination as defined in claim 13 wherein the transverse section moduli of said flexible tail portion decrease in magnitude relative to their increased distances from said head portion.

15. The combination as defined in claim 11 wherein said head portion defines a circumferential groove facilitating connection of said head portion to a support plate or the like having an aperture therethrough adapted for cooperation with said groove.

16. The combination as defined in claim 11 wherein said distal end has greater lateral flexibility than said flexible tail portion.

17. The combination as defined in claim 11 wherein said strain relief is molded on said cord.

* * * * *